US010465993B2

(12) United States Patent
Kong

(10) Patent No.: US 10,465,993 B2
(45) Date of Patent: Nov. 5, 2019

(54) PLATE STACK STRUCTURE FOR SECURELY FIXING PLATE STACKS

(71) Applicant: Gwan Sik Kong, Seongnam-si (KR)

(72) Inventor: Gwan Sik Kong, Seongnam-si (KR)

( * ) Notice: Subject to any disclaimer, the term of this patent is extended or adjusted under 35 U.S.C. 154(b) by 384 days.

(21) Appl. No.: 15/111,101

(22) PCT Filed: Oct. 28, 2014

(86) PCT No.: PCT/KR2014/010184
§ 371 (c)(1),
(2) Date: Aug. 16, 2016

(87) PCT Pub. No.: WO2015/108265
PCT Pub. Date: Jul. 23, 2015

(65) Prior Publication Data

US 2016/0348984 A1 Dec. 1, 2016

(30) Foreign Application Priority Data

Jan. 14, 2014 (KR) ..... 10-2014-0004656

(51) Int. Cl.

| | |
|---|---|
| ***F28D 9/00*** | (2006.01) |
| ***H01F 27/245*** | (2006.01) |
| ***H01F 27/08*** | (2006.01) |
| ***F28F 3/08*** | (2006.01) |
| ***F28F 1/04*** | (2006.01) |

(52) U.S. Cl.
CPC ..... *F28D 9/0093* (2013.01); *H01F 27/08* (2013.01); *H01F 27/245* (2013.01); *F28F 1/045* (2013.01); *F28F 3/08* (2013.01)

(58) Field of Classification Search
CPC ..... F28D 9/0093; F28F 1/045; F28F 3/08
USPC ..... 165/154–156, 185
See application file for complete search history.

(56) References Cited

U.S. PATENT DOCUMENTS

| | | | | |
|---|---|---|---|---|
| 3,370,714 A * | 2/1968 | Trawinski | ..... | B01D 21/02 210/519 |
| 4,369,835 A * | 1/1983 | Goudy, Jr. | ..... | F28F 13/003 165/154 |
| 4,696,010 A * | 9/1987 | Eastman | ..... | H01S 3/0401 372/107 |
| 5,114,588 A * | 5/1992 | Greene | ..... | B01D 65/00 210/321.68 |

(Continued)

FOREIGN PATENT DOCUMENTS

| | | | | |
|---|---|---|---|---|
| EP | 0382305 A1 * | 8/1990 | ..... | F28F 9/262 |
| JP | 08-037259 A | 2/1996 | | |

(Continued)

OTHER PUBLICATIONS

International Search Report dated Feb. 6, 2015, issued to Internal Application No. PCT/KR2014/010184.

*Primary Examiner* — Paul Alvare
(74) *Attorney, Agent, or Firm* — Stein IP, LLC

(57) ABSTRACT

A plate stack structure including plate stacks is disclosed. The plate stack structure according to the present invention includes: a base; a plurality of plate stacks having a predetermined shape; a plurality of fixing parts for fixing the plate stacks, respectively; a cover coupled to an end surface of an edge of the base, the cover holding the plate stacks therein; and a support plate commonly placed in the plate stacks, the support plate coming into contact with an inner surface of the cover.

4 Claims, 10 Drawing Sheets

(56) References Cited

U.S. PATENT DOCUMENTS

| | | | | |
|---|---|---|---|---|
| 5,215,663 | A * | 6/1993 | Greene | B01D 63/16 210/321.68 |
| 6,815,606 | B1 * | 11/2004 | Chung | H02G 13/00 174/3 |
| 2002/0092762 | A1 * | 7/2002 | Zebuhr | B01D 1/28 203/71 |
| 2002/0144809 | A1 * | 10/2002 | Siu | B21D 53/04 165/185 |
| 2002/0195231 | A1 * | 12/2002 | Siu | B21D 53/04 165/104.33 |
| 2004/0007350 | A1 * | 1/2004 | Wu | B01J 19/0013 165/156 |
| 2004/0007518 | A1 * | 1/2004 | Natale | B01D 29/111 210/354 |
| 2006/0231992 | A1 * | 10/2006 | Iannarelli | E02F 9/00 267/140 |
| 2014/0090612 | A1 * | 4/2014 | Hayashi | F01L 1/3442 123/90.15 |

FOREIGN PATENT DOCUMENTS

| | | | |
|---|---|---|---|
| KR | 10-0433011 | B1 | 5/2004 |
| KR | 10-2013-0044275 | A | 5/2013 |

* cited by examiner

PLATE STACK STRUCTURE FOR SECURELY FIXING PLATE STACKS

CROSS-REFERENCE TO RELATED APPLICATIONS

This application is a national stage of International Application No. PCT/KR2014/010184, filed Oct. 28, 2014, which claims the benefit of priority to Korean Application No. 10-2014-0004656, filed Jan. 14, 2014, in the Korean Intellectual Property Office, the disclosures of which are incorporated herein by reference.

TECHNICAL FIELD

The present invention relates generally to a plate stack structure. More particularly, the present invention relates to a plate stack structure for securely fixing plate stacks in which plates having predetermined shapes are arranged in a predetermined way.

BACKGROUND ART

In general, a plate stack structure has been applied to and used in various technical fields to discharge energy introduced thereto or to transmit the energy to another structure. The plate stack structure includes plate stacks and support bodies for supporting the plate stacks.

Each of the plate stacks is configured in such a manner that a plurality of plates having predetermined shapes are arranged and stacked, and is used as cooling fins for discharging heat, produced when driving electronic equipment, to the outside. In addition, the plate stack used in a transformer is configured in such a manner that after iron cores having the same shape are stacked, a primary coil and a secondary coil are wound on different positions of the iron cores. When an electric current is applied to the primary coil, a voltage is induced on the secondary coil by a change in the electric current due to a change in magnetic lines of force. Additionally, a hard disk is configured in such a manner that a plurality of disks are stacked, wherein tracks formed on the disk are recorded with data electronically, and the data recorded on the tracks are retrieved by using an additionally provided head.

Cooling fins for discharging thermal energy to outside air, a transformer for changing electric energy, and disks of a hard disk are required to be stacked and fixed in predetermined shapes and at predetermined intervals to perform energy transmission. To this end, the plate stacks are fixed by using fixing parts. Such a plate stack structure requires high precision, which is closely related to efficiency of equipment. Here, the energy may be various types of energy such as thermal energy, electric energy, spatial energy, and Chi energy.

Meanwhile, the plate stack structure is generally mounted to a fixed place and used at the fixed place. However, when the plate stack structure is mounted to a moving object such as an airplane, a ship, or a vehicle, it may be deformed by variable external forces, which may lead to low energy efficiency and even malfunction thereof.

Furthermore, when the plate stacks are considerably heavy, the fixing parts supporting weights thereof may be deformed by the weights, and thus equipment mechanically or electrically connected to the plate stack structure may malfunction.

Accordingly, the plate stack structure requires enough rigidity to be used in various situations such as a situation in which the shape of equipment may be deformed by its own weight; an installed situation, for example, a situation in which equipment is installed in a direction different from the direction of gravity; and a situation in which equipment is designed to move.

DISCLOSURE

Technical Problem

Accordingly, the present invention has been made keeping in mind the above problems occurring in the related art, and the present invention is intended to propose a rigid plate stack structure, in which support bodies are not deformed by weights of the plate stacks.

In addition, the present invention is intended to propose a plate stack structure, in which plates having predetermined shapes and constituting the stacks are coupled to each other while being spaced apart from each other at predetermined intervals, thereby providing high precision.

Furthermore, the present invention is intended to propose a plate stack structure, in which the plate stack structure is not deformed under various situations such as when used in fixed equipment or in a moving object.

The technical problems to be solved in the present invention are not limited to above-mentioned problems. Additionally, other technical problems that are not mentioned above will be appreciated by those skilled in the arts that belong to the present invention due to the descriptions hereinbelow.

Technical Solution

In order to achieve the above object, according to one aspect of the present invention, there is provided a plate stack structure including plate stacks, the plate stack structure including: a base; a plurality of plate stacks having a predetermined shape; a plurality of fixing parts for fixing the plate stacks, respectively; a cover coupled to an end surface of an edge of the base, the cover holding the plate stacks therein; and a support plate commonly placed in the plate stacks, the support plate coming into contact with an inner surface of the cover.

The support plate may include an upper support plate and a lower support plate that are combined with the plate stacks.

Each of the fixing parts may include a head, a fixing rod, and a fastener, and each of the plate stacks may be fixed by the fixing rod of an associated fixing part, the fixing rod being provided with a first screw part and a second screw part formed respectively on an upper part and a lower part thereof, and the head being coupled to the first screw part.

Each of the fixing parts may include a head, a fixing rod, and a fastener, and the upper support plate may be mounted between the plate stacks and the heads of the fixing parts, and the lower support plate may be mounted between the plate stacks and the base.

The plate stacks may include shaped plates that are formed by continuously arranging polygonal shaped bodies to form a circular arrangement of the shaped plates, the shaped bodies being arranged in radial directions at same angles relative to a center of the circular arrangement of the shaped plates, with a space defined in the center of the circular arrangement of the shaped plates.

Each of the shaped bodies may be further provided with a through hole at a center thereof such that a fixing rod of an associated one of the fixing parts passes through the through hole.

The fixing rod may be a square rod, and one side surface of the square fixing rod and a lower edge of the head may be configured to be parallel to each other.

Each of the fixing parts may be configured to include a square fixing rod, whereby one side surface of the square fixing rod and an outside surface of an associated shaped body may be configured to be parallel to each other.

The cover may be provided with a through hole on a top surface thereof.

Advantageous Effects

The plate stack structure according to the present invention can efficiently distribute weights of the plate stacks via combination of the support plate and the cover.

In addition, the plate stack structure according to the present invention can more securely hold the plate stacks by bringing each of the plate stacks into close contact with the head of the fixing rod and the base at a position between the head and the base.

Furthermore, the plate stack structure according to the present invention is configured in such a manner that the plates and the shaped bodies are symmetrical relative to the centers of the circular arrangements of the plates and the shaped bodies respectively, and one side surface of the fixing rod having a predetermined angled shape and an outside surface of each of the plates are parallel to each other, thereby enabling the plate stack structure to be properly balanced.

DESCRIPTION OF THE REFERENCE NUMERALS IN THE DRAWINGS

Figure 1:
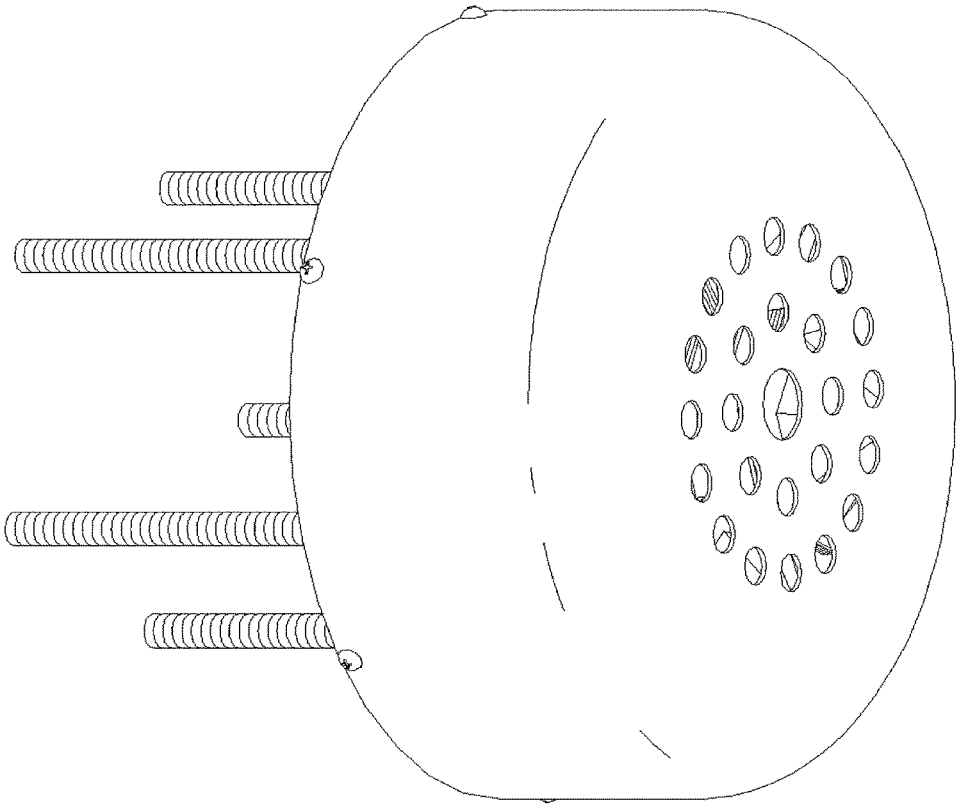
FIG. 1 is a perspective view of a plate stack structure according to an embodiment of the present invention.

100: Base
200: Plate Stack
210: Plate
210*a*: Shaped plate
210*b*: Space plate
211: Plate through hole
300: Fixing part
310: Head
320: Fixing rod
321: First screw part
322: Body
323: Second screw part
330: Fastener
400: Cover
410: Cover through hole
500: Support plate
510: Upper support plate
511: Ring part of upper support plate
520: Lower support plate
521: Ring part of lower support plate
V: Space

BEST MODE

Hereinbelow, an exemplary embodiment of the present invention will be described in detail referring to the accompanying drawings. The present invention may be realized in various ways, and is not limited to the embodiment thereof described herein. In the drawings, the shapes and sizes of members may be exaggerated, simplified, and omitted for explicit and convenient description. Further, an element expressed in a singular form includes plural elements.

Figure 2:
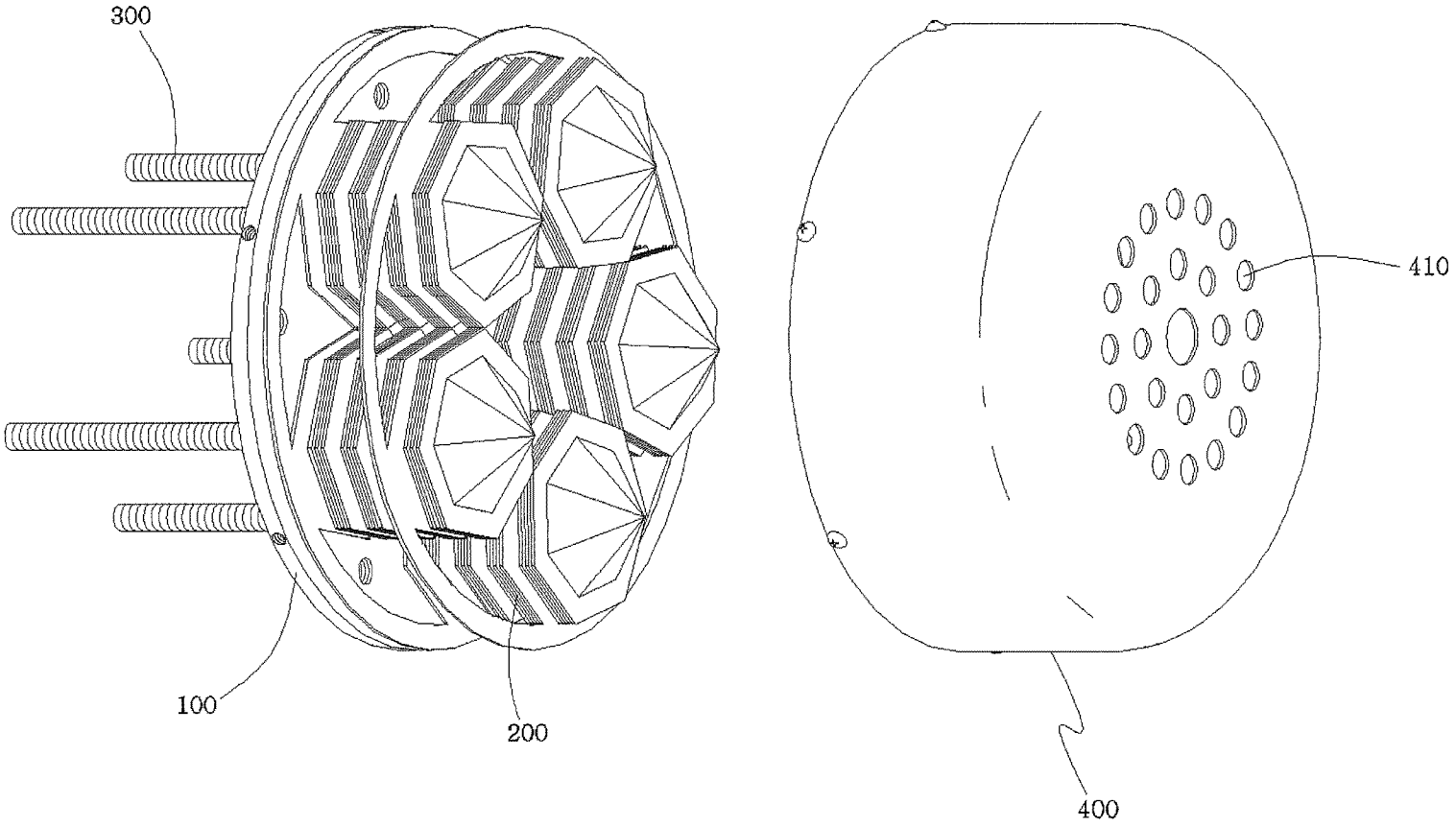
FIG. 2 is a perspective view showing removal of a cover from the plate stack structure according to the embodiment of the present invention.
Figure 3:
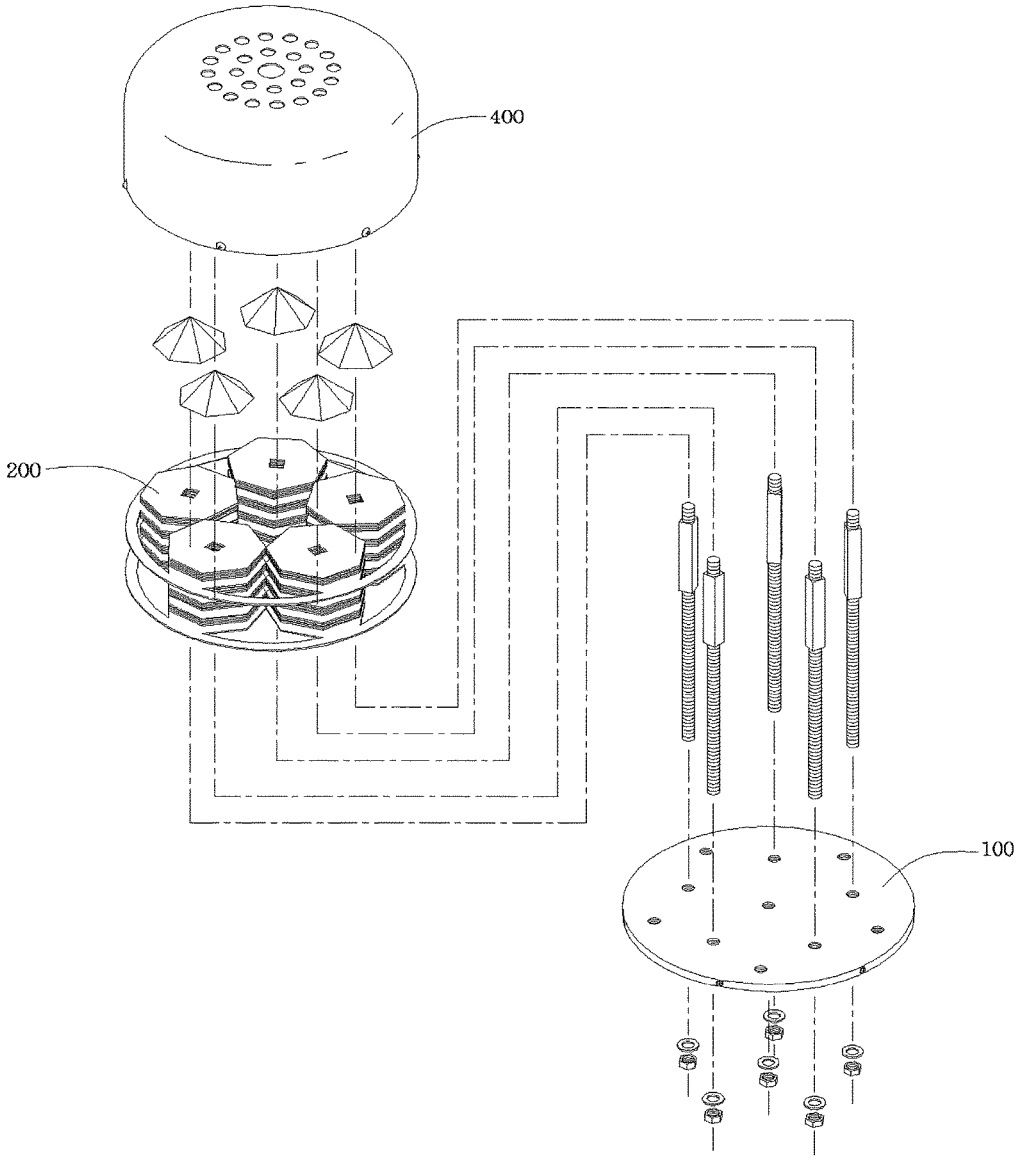
FIG. 3 is an exploded perspective view of the plate stack structure according to the embodiment of the present invention.

FIG. 1 is a perspective view of a plate stack structure according to an embodiment of the present invention. FIG. 2 is a perspective view showing removal of a cover from the plate stack structure according to the embodiment of the present invention. FIG. 3 is an exploded perspective view of the plate stack structure according to the embodiment of the present invention.

The plate stack structure according to the embodiment of the present invention includes: a base 100; plate stacks 200 having a predetermined shape; a plurality of fixing parts 300 for fixing the plate stacks 200; and a cover 400 coupled to an end surface of an edge of the base, the cover holding the plate stacks therein.

Referring to the drawings, the base 100 has a circular shape, and five fixing rods 320 pass through the base 100. The cover 400 having a bowel shape is fitted over the end surface of the edge of the base 100. Although the plate stack structure may be installed in various directions, the base 100 stands vertically according to the embodiment of the present invention. Accordingly, the plate stack structure may be mounted to an additional support while standing, so the cover 400 is coupled to the base 100 while standing. In addition, the cover 400 is provided with a plurality of cover through holes 410 on a top surface thereof, and thus the plate stack structure can efficiently transmit and discharge energy.

Figure 4:
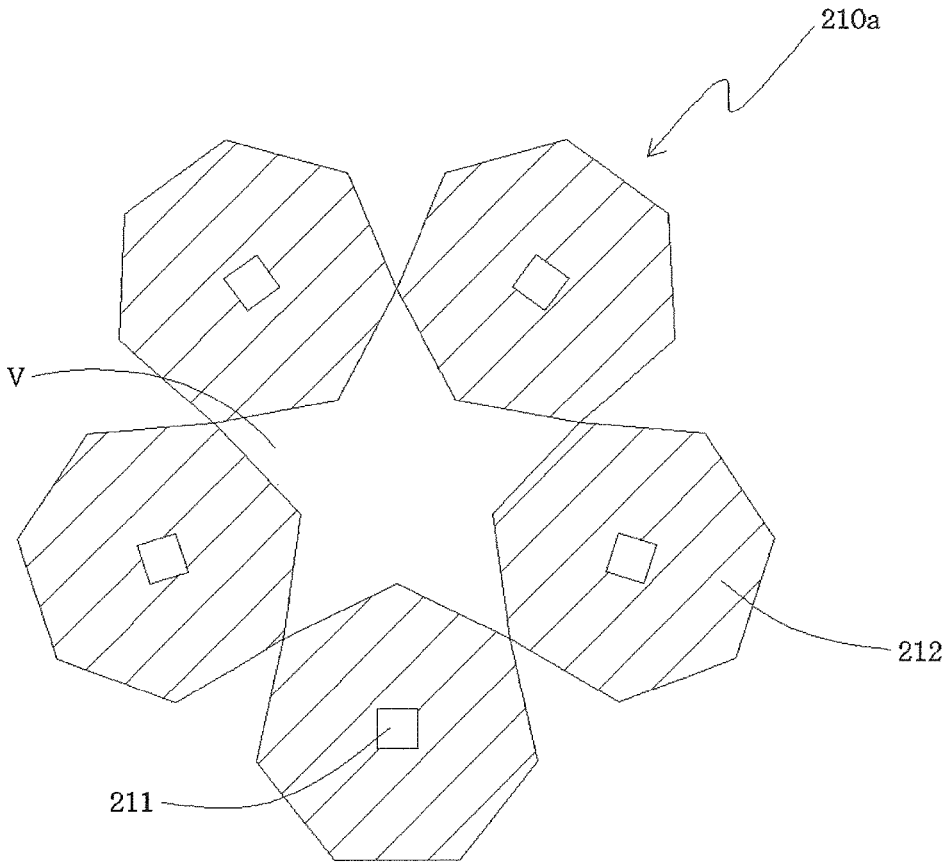
FIG. 4 is a view showing shaped plates according to the embodiment of the present invention.
Figure 5:
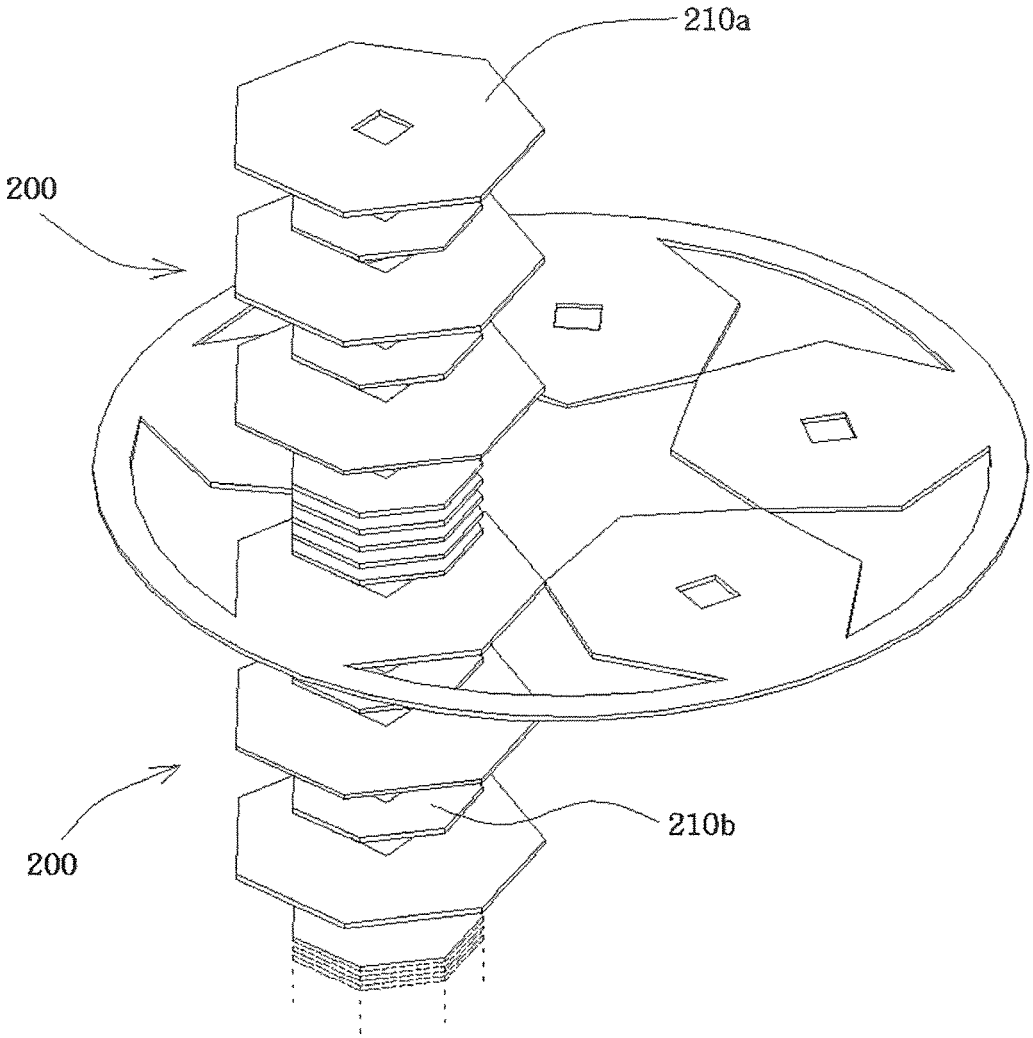
FIG. 5 is a view showing plates according to the embodiment of the present invention.

FIG. 4 is a view showing shaped plates according to the embodiment of the present invention. FIG. 5 is a view showing plates according to the embodiment of the present invention.

Referring to FIGS. 4 and 5, the plate stacks 200 include a plurality of plates 210 having predetermined shapes, and the plurality of plates 210 are arranged to be spaced apart from each other at predetermined intervals, or to come into surface contact with each other. The plates 210 include shaped plates 210*a* having shaped bodies, and space plates 210*b* placed between the shaped plates. The shaped plates 210*a* and the space plates 210*b* are provided with respective plate through holes 211 such that the fixing rod 320 of a fixing part 300 passes through the plate through holes 211 of the plates 210*a* and 210*b* of a plate stack 200.

Each of the plates 210 constituting the plate stacks 200 may be made of metal that can efficiently discharge or transmit energy. Preferably, the metal may be aluminum, which is a relatively light metal.

Referring to FIG. 4, the shaped plates 210*a* are formed by continuously arranging polygonal shaped bodies (designated by no reference numeral) such that the polygonal shaped bodies form a circular arrangement of the shaped plates 210*a*, with a space V defined at a center of the circular arrangement of the shaped plates 210*a*. In the embodiment, each of the shaped bodies has a heptagonal shape. The shaped bodies are arranged in radial directions at same distances and at same angles relative to the center of the circular arrangement of the shaped plates 210*a*.

Although the space plates 210*b* have the same shape of the shaped bodies of the shaped plates 210*a*, the size of the space plates is smaller than the size of the shaped bodies of the shaped plates 210*a*. Each of the shaped plates 210*a* includes five shaped bodies. When the plate stacks 200 are formed by placing the space plate 210*b* between two shaped plates, five space plates are respectively arranged at locations corresponding to the shaped bodies of the shaped plates 210*a*. Here, the space plates are interposed between the shaped plates. For reference, FIG. 5 shows that the plates of a plate stack are fixed by a fixing rod, for ease of description of the embodiment of the present invention.

Meanwhile, a plurality of shaped plates 210*a* and a plurality of space plates 210*b* may be stacked on each other, respectively, and the stacked shaped plates and the stacked space plates may be alternately stacked on each other to come into surface contact with each other.

When stacking the shaped plates 210*a* and the space plates 210*b*, it is required to fix the plates 210*a* and 210*b* so as not to allow the plates from being separated from each other. To this end, the shaped bodies of the shaped plates 210*a* and the space plates 210*b* are provided with respective plate through holes 211 at centers thereof. Due to the plate through holes 211, the shaped plates 210*a* and the space plates 210*b* can be stacked on each other and can be arranged in a predetermined way by being fitted over the fixing rods 320.

Hereinbelow, the fixing part according to the embodiment of the present invention will be described in detail.

Figure 6:
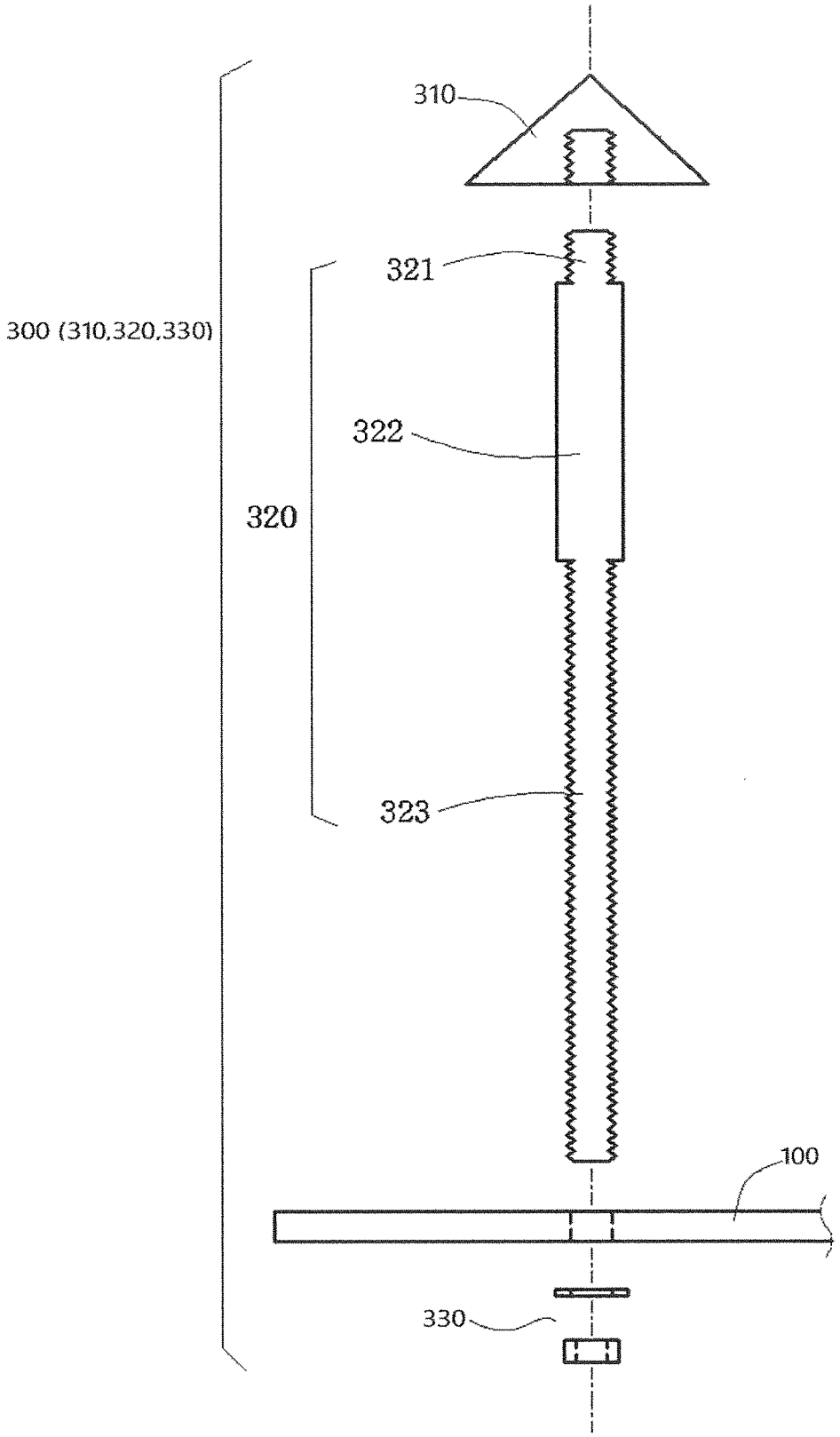
FIG. 6 is a view showing a fixing part of the plate stack structure according to the embodiment of the present invention.
Figure 7:
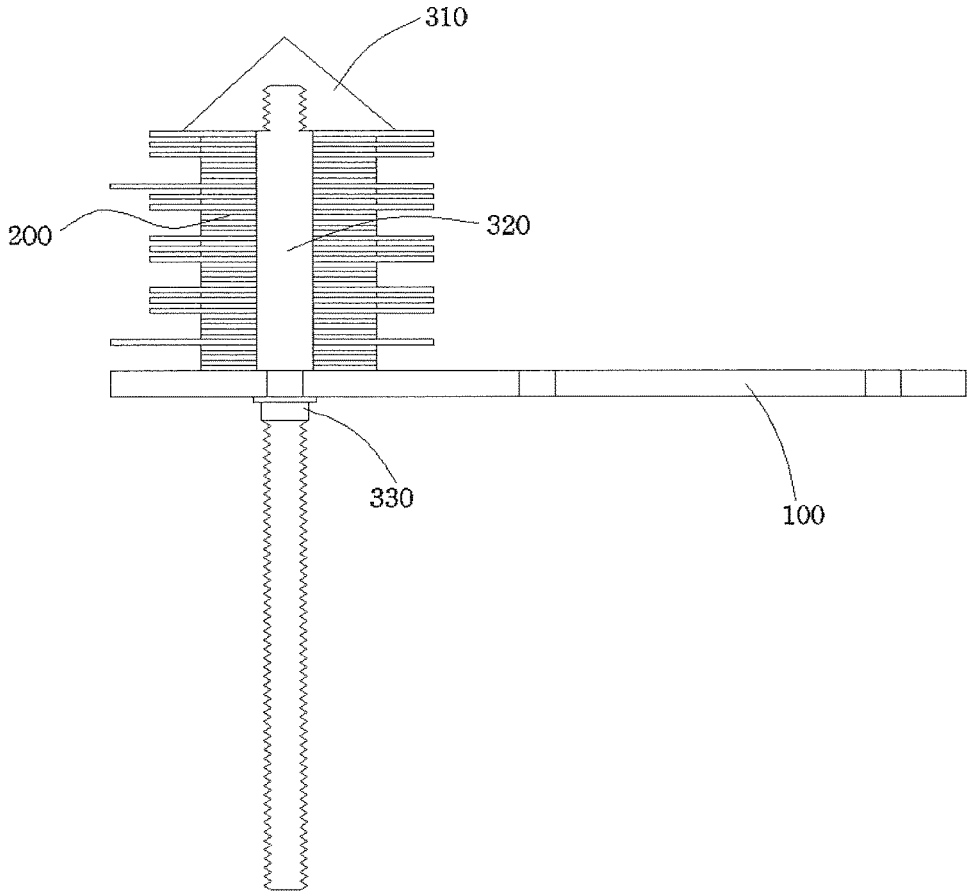
FIG. 7 is a view showing combination of the plates with the fixing part according to the embodiment of the present invention.

FIG. 6 is a view showing the fixing part of the plate stack structure according to the embodiment of the present invention. FIG. 7 is a view showing combination of the plates with the fixing part according to the embodiment of the present invention.

According to the embodiment of the present invention, the plate stacks 200 are arranged by using five fixing rods 320. However, when forming the plate stacks 200 by arranging the plates having circular through holes by using fixing rods 320 having circular cross-sections, the fixing rods and the plates come into contact with each other at circular contact junctions, and thus arrangement of the plates may be easily disorganized by an external force.

To prevent this, according to the present invention, the cross-section of the fixing rod 320 and the through holes of the plates may be configured to have polygonal shapes. Here, the polygonal shapes may be shapes having three or more angles. According to the embodiment of the present invention, the fixing rod 320 is configured to have a square cross-section. Additionally, the through hole of each of the plates has a square shape of a size corresponding to the size of the square fixing rod 320.

The fixing part 300 of the plate stack structure according to the embodiment of the present invention is configured to include a head 310, the fixing rod 320, and a fastener 330.

The head 310 has a shape of a heptagonal pyramid. The head 310 is configured to have a flat surface on a lower end surface thereof such that the head and the uppermost plate come into surface contact with each other, and the lower end surface is provided with a threaded hole in a center thereof such that a first screw part 321 of the fixing rod 320 is screwed to the threaded hole.

The fixing rod 320 includes the first screw part 321, a body 322, and a second screw part 323. The body 322 of the fixing rod 320 is configured to have a square cross-section. The body 322 is provided between an upper part and a lower part of the fixing rod 320, and the first screw part 321 and the second screw part 323 are provided on the upper part and the lower part of the fixing rod 320, respectively. The fixing rod 320 is engaged with the head 310 at the first screw part 321 thereof, and is engaged with the fastener 330 at the second screw part 323 thereof.

The plates of the plate stacks 200 are fitted over the fixing rod 320, and are tightly fastened to each other by the head 310 and the fastener 330. To be specific, after the first screw part 321 of the fixing rod 320 is screwed to the head 310, the plates of the plate stacks 200 are fitted over the body 322 of the square fixing rod 320, and the second screw part 323 of the fixing rod is coupled to a through hole of the base 100 and is fastened by the fastener.

Referring to FIG. 7, the fixing rod 320 is engaged with the head 310 at the first screw part thereof such that the plates are not undesirably removed from the fixing rod. An outer diameter of the first screw part 321 is configured to be shorter than the length of a diagonal line of the square body 322 of the fixing rod 320. When the first screw part 321 of the fixing rod 320 is tightly screwed to the threaded hole formed in the lower end surface of the head 310, the first screw part 321 is not visible from the outside.

Figure 8:
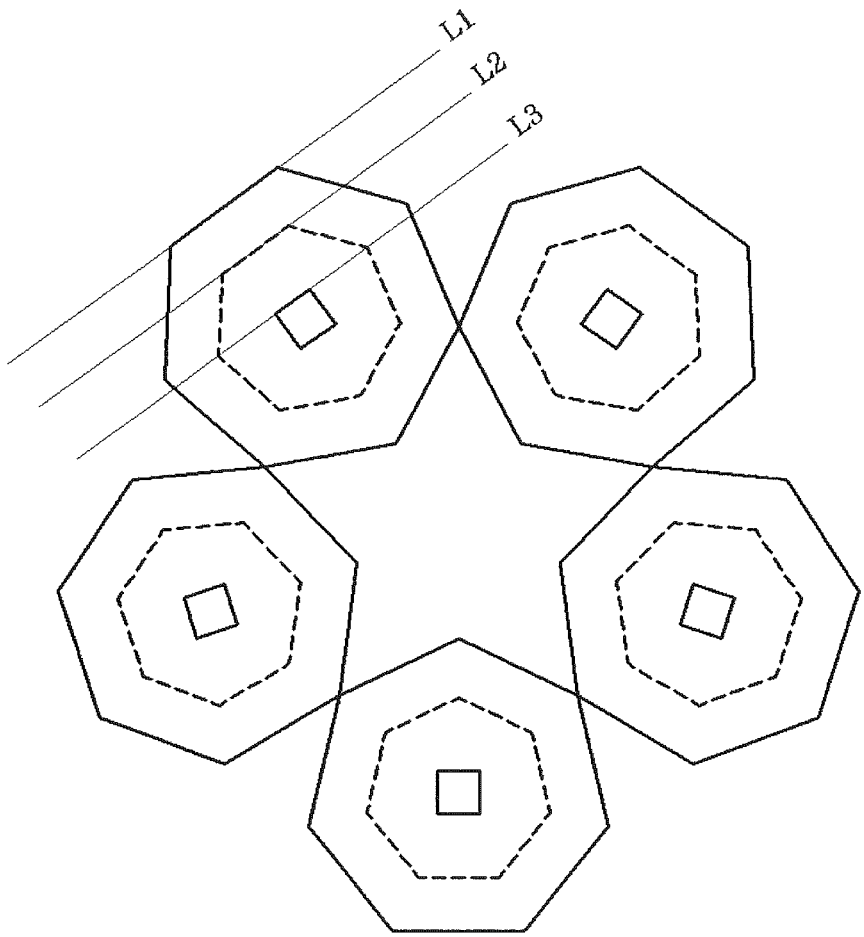
FIG. 8 is a view showing an arrangement of a through hole of the plate and a head of the fixing part.

FIG. 8 is a view showing an arrangement of the through hole of the plate and the head of the fixing part.

Referring to FIG. 8, in the embodiment of the present invention, the plates and the shaped bodies are symmetrical relative to the centers of circular arrangements of the plates and the shaped bodies. In such a symmetrical structure, one side surface of the fixing rod 320 having predetermined angles and an outside surface of each of the plates are required to be parallel to each other so as to properly balance the structure.

According to the present invention, the length of the threaded hole of the head 310 and the length of the first screw part 321 are configured to be exactly same such that the side surface of the body 322 of the square fixing rod 320 and a lower edge of the head 310 having a shape of a heptagonal pyramid are parallel to each other. Such a configuration enables the plate stack structure to balance itself relative to a center thereof.

As shown in FIG. 8, a dotted line shown in an inner part of the shaped body indicates the edge of the lower end surface of the head 310, and L1, L2, and L3 indicate lines passing by an outside surface of the shaped body, the lower edge of the head 310, and a side surface of the through hole of the shaped body. Here, L1, L2, and L3 are parallel to each other.

Meanwhile, the fastener 330 is fastened to the second screw part 323 of the fixing rod 320 so the plates come into close contact with the base 100. Here, the plates are configured to come into close contact with each other so as to increase precision. According to the embodiment of the present invention, the fastener 330 comprises a washer and a nut.

Hereinbelow, a support plate 500 further provided in the plate stack structure according to the embodiment of the present invention will be described in detail.

Figure 9:
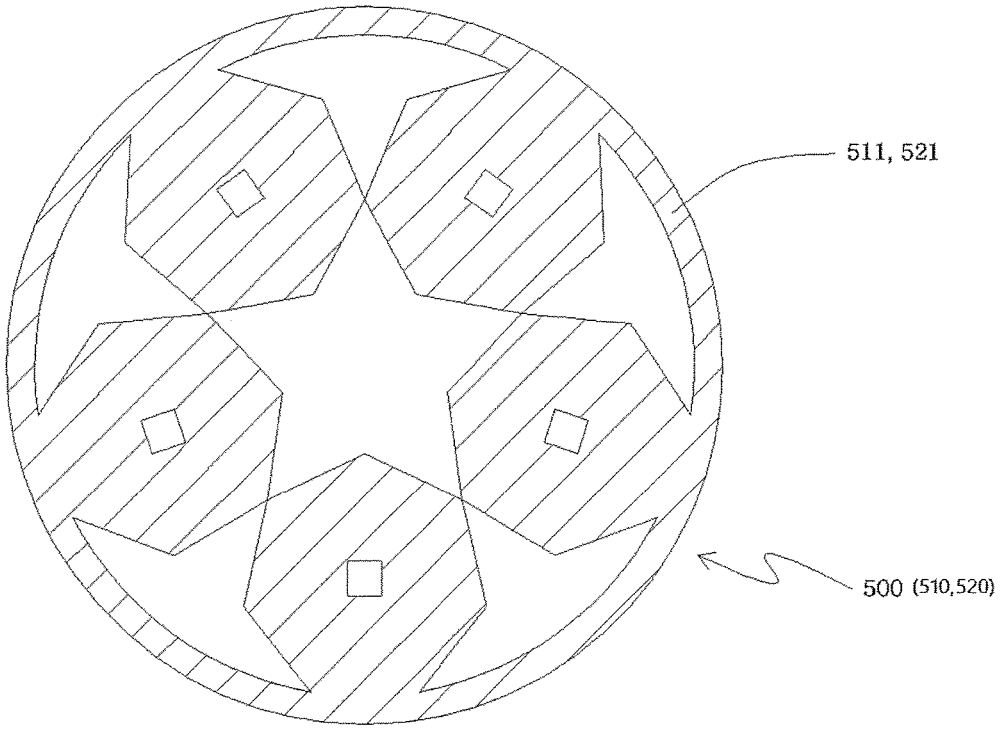
FIG. 9 is a view showing a support plate according to the embodiment of the present invention.
Figure 10:
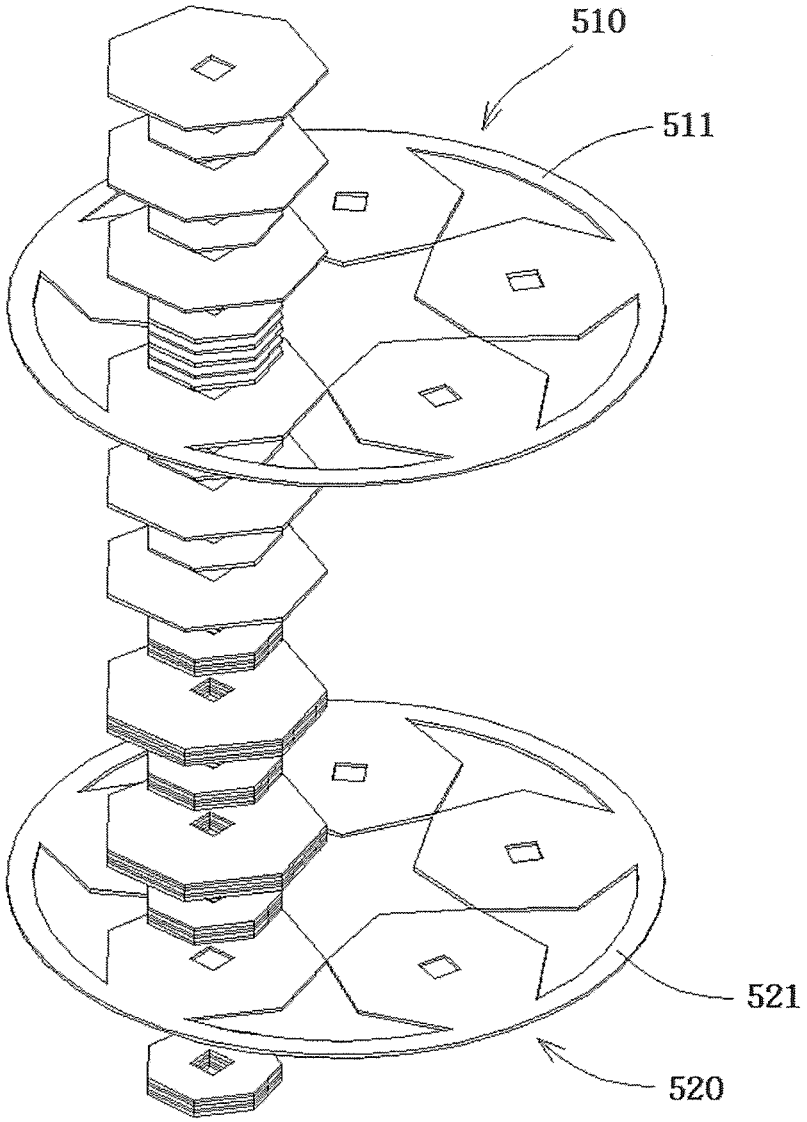
FIG. 10 is a view showing positions of support plates relative to a plate stack according to the embodiment of the present invention.

FIG. 9 is a view showing the support plate according to the embodiment of the present invention. FIG. 10 is a view showing positions of the support plates relative to a plate stack according to the embodiment of the present invention.

The plate stack structure according to the present invention may be installed standing. In this case, weights of the plate stacks 200 concentrate on regions on which the plate stacks 200 and the fixing rods 320 are coupled to each other. Although the plate stack structure is mounted to fixed equipment instead of moving equipment, the fixing rod 320 may be easily deformed by the plate stacks 200 having the weights, and thus may separate from the base 100, or may be bent.

The support plate 500 supports the plate stacks 200 coupled to the bodies of the fixing rods 320. Heavy weights of the plate stacks 200 applied in a gravitational direction may be changed depending on an angle at which the plate stack structure is fixed to equipment, and depending on a moving direction of the equipment. In this case, since the weights of the plate stacks 200 are applied to the fixing rods 320 supporting the plate stacks 200, it is necessary that the fixing rods are configured to be large in thickness, or a fixing plate of the equipment to which the fixing rods 320 are fixed is configured to be strong. Here, the fixing plate refers to a mounting surface of equipment to which the stack structure according to the present invention is mounted.

In this present invention, considering distribution of weights, the plate stacks 200 are further provided with the support plate 500. The support plate 500 includes an upper support plate 510 and a lower support plate 520.

Referring to the drawings, the upper support plate 510 is mounted between the plate stacks 200 and the heads 310. Plates of the upper support plate 510 have the same shapes of the plates of the plate stacks 200, and additionally, the upper support plate is integrally provided with a single circular ring part 511 on a circumference thereof. The ring part comes into contact with an inner surface of the cover 400 on an end surface thereof.

An outer diameter of the support plate 500 and an outer diameter of the base 100 are same in length. A part except for a top surface of the cover 400 has a cylindrical shape, and a bottom part of the cover 400 is open. The bottom part is coupled to the end surface of the edge of the base 100 on an end part thereof, and the cover 400 is configured to come into contact with an outer circumferential surface of the support plate 500, that is, the surface of an edge of the ring part on the inner surface of the cover 400.

The lower support plate 520 has a same shape of the upper support plate 510. The upper support plate 510 and the lower support plate 520 are different only in that they are mounted to different locations of the plate stacks 200. The upper support plate 510 is mounted between the plate stacks 200 and the head 310, and the lower support plate 520 is mounted to a position spaced apart from the upper support plate 510 at a predetermined interval. Preferably, the lower support plate 520 is mounted between the upper support plate 510 and the base 100.

Although the support plate 500 is mounted between the plates of the plate stacks 200 as shown in the drawings, according to the embodiment of the present invention, the lower support plate 520 is mounted between the upper support plate 510 and the base 100. Considering securing a distance spaced apart from the upper support plate 510 and a size of the plate stack structure, the lower support plate 520 may be mounted in middle parts of the stacks 200. In addition, a middle support plate may be provided between the upper support plate 510 and the lower support plate 520.

The upper support plate 510 and the lower support plate 520 distribute weights of the plate stacks 200. The plate stacks 200 stacked with a plurality of plates are heavy. When the plate stack structure is laid horizontally, the fixing rod 320 may be bent, or separated from the fixing plate by the stacks 200 having heavy weights. Ring parts 511, 521 formed on the upper support plate 510 and the lower support plate 520, respectively, come into surface contact with the cover 400 by coming into close contact with the inner surface of the cover on the end surface of the edge of each of the ring parts, thereby distributing weight that the fixing rod 320 supports.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A plate stack structure including plate stacks, the plate stack structure comprising:

a base;

a plurality of plate stacks having a predetermined shape;

a plurality of fixing parts for fixing the plate stacks, respectively;

a cover coupled to an end surface of an edge of the base, the cover holding the plate stacks therein; and support plates placed in the plate stacks, the support plates being in contact with an inner surface of the cover, wherein the support plates comprise an upper support plate and a lower support plate, the upper support plate and the lower support plate further including respective ring parts, each of the ring parts being an integral part of the respective upper or lower support plate, wherein each of the fixing parts includes a head, a fixing rod, and a fastener, and each of the plate stacks is fixed by the fixing rod of the fixing part, the fixing rod being provided with a first screw part and a second screw part formed respectively on an upper part and a lower part thereof, and the head being coupled to the first screw part while the fastener being coupled to the second screw part, wherein each of the upper and lower support plates is mounted between two of the plate stacks, wherein the plate stacks include shaped plates and space plates, the shaped plates being formed by continuously arranging polygonal shaped bodies to form a circular arrangement of the shaped plates, the polygonal shaped bodies being arranged in radial directions at same angles relative to a center of the circular arrangement of the shaped plates, with a space defined in the center of the circular arrangement of the shaped plates, each of the space plates being smaller than each of the polygonal shaped bodies of the shaped plates, each of the space plates being sandwiched between two of the shaped plates, wherein each of the shaped plates and each of the space plates are further provided with a plate through hole at a center thereof such that the fixing rod of the fixing parts passes through the plate through hole, wherein the cover is provided with a cover through hole on a top surface thereof.

2. The plate stack structure of claim 1, wherein the support plates further comprise a middle support plate disposed between the upper and lower support plates.

3. The plate stack structure of claim 1, wherein the fixing rod is a square rod, and one side surface of the square fixing rod and a lower surface of the head are configured to be parallel to each other.

4. The plate stack structure of claim 2, wherein the fixing rod is a square rod, and one side surface of the square fixing rod and a lower surface of the head are configured to be parallel to each other.

* * * * *